US007645200B2

(12) United States Patent
Downey

(10) Patent No.: US 7,645,200 B2
(45) Date of Patent: Jan. 12, 2010

(54) GOLF BALL RETRIEVAL SYSTEM

(76) Inventor: Burns P. Downey, 2600 S. Finley Rd., No. 3515, Lombard, IL (US) 60148

( * ) Notice: Subject to any disclaimer, the term of this patent is extended or adjusted under 35 U.S.C. 154(b) by 57 days.

(21) Appl. No.: 12/014,445

(22) Filed: Jan. 15, 2008

(65) Prior Publication Data

US 2008/0176668 A1 Jul. 24, 2008

Related U.S. Application Data

(60) Provisional application No. 60/884,905, filed on Jan. 15, 2007.

(51) Int. Cl.
*A63B 47/02* (2006.01)

(52) U.S. Cl. ..... 473/286; 294/19.2

(58) Field of Classification Search ..... 473/286; 294/19.2

See application file for complete search history.

(56) References Cited

U.S. PATENT DOCUMENTS

| | | | | |
|---|---|---|---|---|
| 802,264 | A | 10/1905 | Brown | |
| 1,658,145 | A | 2/1928 | Uyei | |
| 2,658,785 | A | 11/1953 | Jones | |
| 3,318,628 | A | 5/1967 | White | |
| 3,698,720 | A | 10/1972 | Gudmundsen | |
| 4,687,204 | A * | 8/1987 | Lempio | 473/286 |
| 4,787,632 | A | 11/1988 | Nigrelli et al. | |
| 5,004,240 | A | 4/1991 | Tsukamoto | |
| 5,924,175 | A * | 7/1999 | Lippitt et al. | 24/537 |
| 6,171,202 | B1 * | 1/2001 | Schmitt | 473/286 |
| 6,190,265 | B1 * | 2/2001 | Schmitt | 473/286 |
| D477,644 | S * | 7/2003 | Schmitt | D21/721 |
| 6,589,123 | B2 * | 7/2003 | Schmitt | 473/286 |
| 6,743,113 | B2 * | 6/2004 | Pettinga et al. | 473/286 |
| D524,886 | S * | 7/2006 | Baril | D21/721 |
| 7,351,156 | B1 * | 4/2008 | Panneri et al. | 473/132 |
| 2002/0155897 | A1 * | 10/2002 | Schmitt | 473/286 |

* cited by examiner

*Primary Examiner*—Stephen L. Blau
(74) *Attorney, Agent, or Firm*—Trexler, Bushnell, Giangiorgi, Blackstone & Marr, Ltd.

(57) ABSTRACT

A golf ball retrieval system is described, for mounting within a golf club, using as a dedicated ball retrieval device, or retrofitting to an existing golf club. The system in a first embodiment comprises a hollow shaft, an anchor member mounted within the shaft, a sliding member movable axially within the shaft, the sliding member having a bore axially therethrough, a plurality of grappling wires connected to a proximal end of the sliding member, a spring connecting the anchor member to the sliding member, a wire placed within the bore, the wire having a first end and a second end, the wire further comprising a handle at the first end, the handle protruding from the bore at the proximal end of the sliding member, the second end of the wire being attached to the spring, and a shoulder attached to the wire between the spring and the sliding member. In a second embodiment, the system comprises a hollow shaft, an anchor member mounted within the shaft, a sliding member movable axially within the shaft, a plurality of grappling wires connected to a proximal end of the sliding member, a cap movable axially within the shaft, the cap located between the sliding member and the anchor member, a spring placed in the shaft between the anchor member and the cap, and a locking assembly between the sliding member and the cap.

6 Claims, 4 Drawing Sheets

GOLF BALL RETRIEVAL SYSTEM

PRIORITY

This application claims priority from U.S. Provisional Patent Application No. 60/884,905, filed Jan. 15, 2007, the disclosure of which is incorporated herein by reference.

FIELD OF THE INVENTION

This invention is generally directed to an apparatus for retrieving golf balls.

BACKGROUND OF THE INVENTION

A golfer has to bend over to pick up golf balls after successfully completing a hole, during practice sessions, or during practice. This motion is difficult for some golfers, due to age or infirmity. Various types of golf ball retrievers have been proposed to allow a golfer to pick up a ball with little bending.

For example, U.S. Pat. No. 1,658,145 describes a device for picking up golf balls, using four tines at the end of a shaft. The tines remain exposed out the end of the shaft, however, which would interfere aesthetically and operationally with a golf club. U.S. Pat. No. 3,318,628 describes a system having the tines hidden within the shaft, but this system requires a knob protruding through an elongated slot in the shaft of the club, which would interfere aesthetically and operationally with a golf club. An alternative embodiment using inertial means would interfere with the balance of a golf club, as well as being difficult to use by the aged or infirm. Similarly, U.S. Pat. No. 5,004,240 describes the use of a push button within the shaft, which would interfere aesthetically as well as operationally with operation of the club.

U.S. Pat. No. 3,698,720 describes a retriever in which the tines, although mostly hidden within the shaft of the club, must protrude sufficiently for the user to grip them to pull them out of the shaft, which would interfere aesthetically as well as operationally with operation of the club. This patent also describes the use of a tongue in the retrieval mechanism, interfacing with a hole in the shaft, to hold the retrieval mechanism in place.

Those prior art devices that require modifications to the shaft, such as holes or slots, cause increased expense during manufacture, weaken the shaft, and are not suited for retrofitting to existing clubs.

A need exists for a simple, easily operable golf ball retriever that does not interfere with the operation of the club, is sufficiently hidden so as not to interfere with the aesthetics of the club, and can be retrofitted to existing golf clubs, inserted into new clubs during manufacture, or used in a dedicated retrieval device. The present application meets these needs.

SUMMARY OF THE INVENTION

The present invention is a golf ball retrieval system mounted within a golf club, used as a dedicated ball retrieval device, or retrofitted to an existing golf club. The system in a first embodiment comprises a hollow shaft, an anchor member mounted within the shaft, a sliding member movable axially within the shaft, the sliding member having a bore axially therethrough, a plurality of grappling wires connected to a proximal end of the sliding member, a spring connecting the anchor member to the sliding member, a wire placed within the bore, the wire having a first end and a second end, the wire further comprising a handle at the first end, the handle protruding from the bore at the proximal end of the sliding member, the second end of the wire being attached to the spring, and a shoulder attached to the wire between the spring and the sliding member. In a second embodiment, the system comprises a hollow shaft, an anchor member mounted within the shaft, a sliding member movable axially within the shaft, a plurality of grappling wires connected to a proximal end of the sliding member, a cap movable axially within the shaft, the cap located between the sliding member and the anchor member, a spring placed in the shaft between the anchor member and the cap, and a locking assembly between the sliding member and the cap.

BRIEF DESCRIPTION OF THE DRAWINGS

The organization and manner of the structure and operation of the invention, together with further objects and advantages thereof, may best be understood by reference to the following description, taken in connection with the accompanying non-scale drawings, wherein like reference numerals identify like elements in which.

DETAILED DESCRIPTION OF THE ILLUSTRATED EMBODIMENTS

Figure 1:
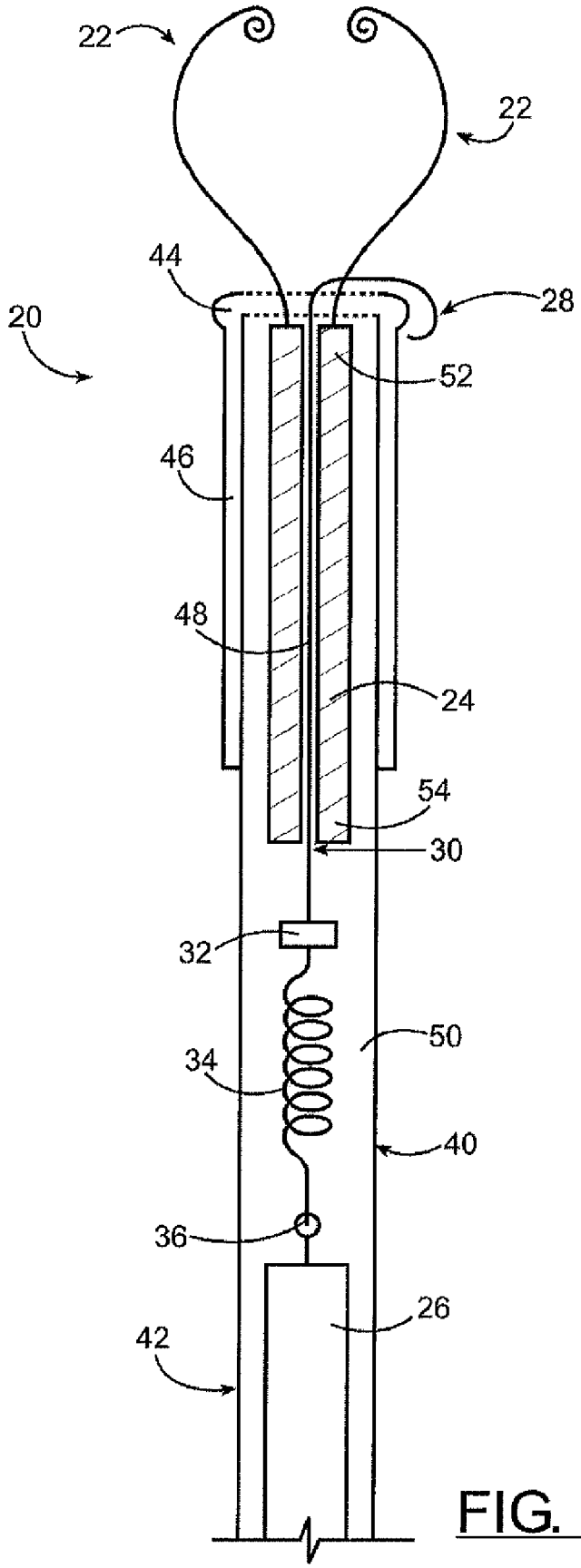
FIG. 1 is a cutaway view of the preferred embodiment of the golf ball retrieval system of the present invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention is a golf ball retrieval system that, in a first embodiment, is mounted within a golf club, preferably a putter. The system can be supplied in a new club or retrofitted to an existing club. In another embodiment, the retrieval system is a dedicated retrieval device.

A first embodiment of the present invention is retrieval system 20, shown in cut-away view in FIG. 1. The system 20 has a plurality of grappling wires 22, a sliding member 24, an anchor member 26, a handle 28, a wire 30, a shoulder 32, a spring 34, and an attachment means 36. As shown, retrieval system 20 is mounted in the top of a hollow shaft 40 of a golf club 42, and protrudes through the modified top 44 of the grip 46 of club 42.

Sliding member 24 is a cylindrical tube having a bore 48 axially therethrough. Sliding member 24 is made of a solid material, such as wood, plastic, or metal. Bore 48 has a diameter sufficient to allow wire 30 to pass freely therethrough. Sliding member 24 has an outer diameter forming a loose interference fit with the bore 50 of shaft 40, so that sliding member 24 will move axially through bore 50 when force is applied, but will stay in position when force is released.

Figure 2:
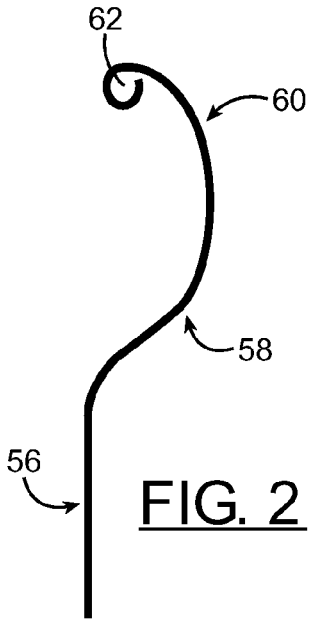
FIG. 2 is a side view of a grappling wire used in the system of FIG. 1.

Grappling wires 22 are mounted in end 52 of sliding member 24. Preferably, there are four grappling wires 22, but a different number can be used. Grappling wires 22 are formed of a resilient material, such as spring steel, and preferably have a circular cross-section. Each grappling wire 22 has an attachment section 56, an outward curving section 58, an inward curving section 60, and a loop 62 formed at the end of inward curving section 60, as illustrated in FIG. 2.

Attachment section 56 of each grappling wire 22 is a straight member configured for attachment to the proximal end 52 of sliding member 24. In a first embodiment, attachment section 56 of each grappling wire 22 is mounted directly to proximal end 52 by drilling holes axially into proximal end 52 and inserting each attachment section 56, securing the attachment by an interference fit, an adhesive, soldering, or other conventional attachment means.

Figure 3:
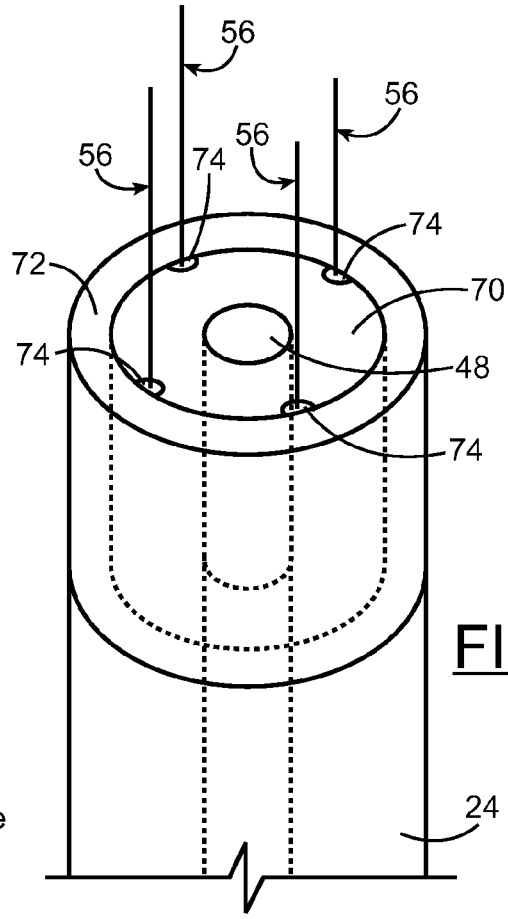
FIG. 3 is a partial cutaway, perspective view of the proximal end of one embodiment of the sliding member used in the retrieval system of FIG. 1.

In another embodiment, sliding member 24 has a head 70 formed at proximal end 52. Head 70 has a smaller diameter than the rest of sliding member 24, as illustrated in FIG. 3. Attachment section 56 of each grappling wire is attached to head 70 by sleeve 72, which slides over head 70, securing attachment section 56 of each grappling wire 22 between head 70 and sleeve 72. Preferably, grooves 74 are formed in one or both of head 70 and sleeve 72, to facilitate attachment. Sleeve 72 is preferably formed of a hard plastic material.

Figure 4:
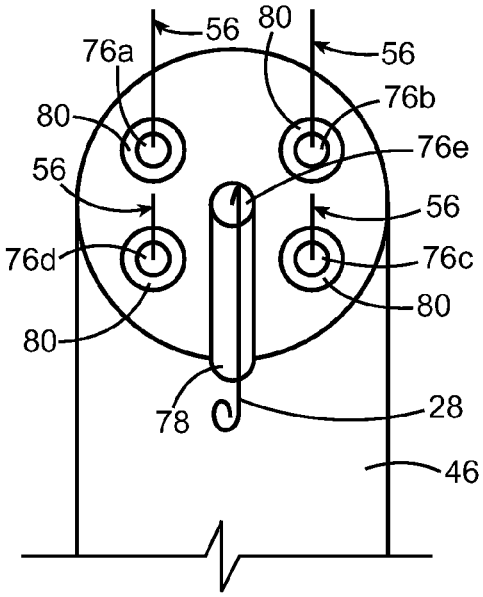
FIG. 4 is a perspective view of the top of the grip of a golf club having a retrieval system of the preferred embodiment of the present invention.

Grip 46 is a standard grip well-known in the art of golf clubs, except having a plurality of holes 76 drilled through top 44. Attachment section 56 of each grappling wire 22 slides through a hole 76. Additionally, handle 28 slides through a hole 76. Thus, in the preferred embodiment, four grappling wires 22 each slide through one of four holes 76*a* through 76*d*, located circumferentially, and handle 28 slides through a centrally located hole 76*e*, as shown in FIG. 4. Centrally located hole 76*e* is, of course, located over bore 48.

Handle 28 is attached to wire 30, which passes through bore 48 of sliding member 24. Shoulder 32 is attached to wire 30 just after distal end 54 of sliding member 24, between sliding member 24 and spring 34. Shoulder 32 is large enough not to pass through bore 48. Spring 34 is attached to shoulder 32 at a first end of spring 34 and attaches to anchor member 26 at a second end of spring 34 by attachment means 36. Attachment means 36 can be an eye-bolt, clip, screw, bolt, adhesive, weld, solder, knot, or other means to secure an end of spring 34 to anchor member 26.

Anchor member 26 in the preferred embodiment is a solid cylinder configured to be held in a single position within bore 50 of shaft 40. Anchor member 26 preferably forms a tight interference fit with bore 50, sufficient to hold anchor member 26 is a single position. In other embodiments, anchor member 26 is glued, soldered, welded, screwed, bolted, or attached by some other means. Anchor member 26 in other embodiments is a simple attachment of spring 34 to the wall of shaft 40, such as a bolt, solder, weld, a hook, or other means of attachment.

During use of club 42 before holing out, spring 34 pulls handle 28 toward anchor member 26, which is in a fixed position. Accordingly, handle 28 is normally resting upon top 44 of grip 46. Preferably, a recess 78 accommodates handle 28.

When a user pulls handle 28 away from top 44, against the pull of spring 34, shoulder 32 encounters distal end 54 of sliding member 24. Since shoulder 32 is larger than bore 48, pulling on handle 28 pulls sliding member 24 towards top 44, causing grappling wires 22 to slide outwardly through holes 76. Since grappling wires 22 are formed of a resilient material, curve sections 58, 60 pop axially outward, forming a configuration suitable for holding a golf ball. When the user releases handle 28, spring 34 pulls handle 28 back toward anchor member 26, so that handle 28 returns to its resting position within groove 74 in top 44 of grip 46. Sliding member 24, however, remains in the same position, as it formed a slight interference fit within bore 50. FIG. 1 shows retrieval system 20 with grappling wires 22 in their extended position and handle 28 returned to its resting position.

Figure 5:
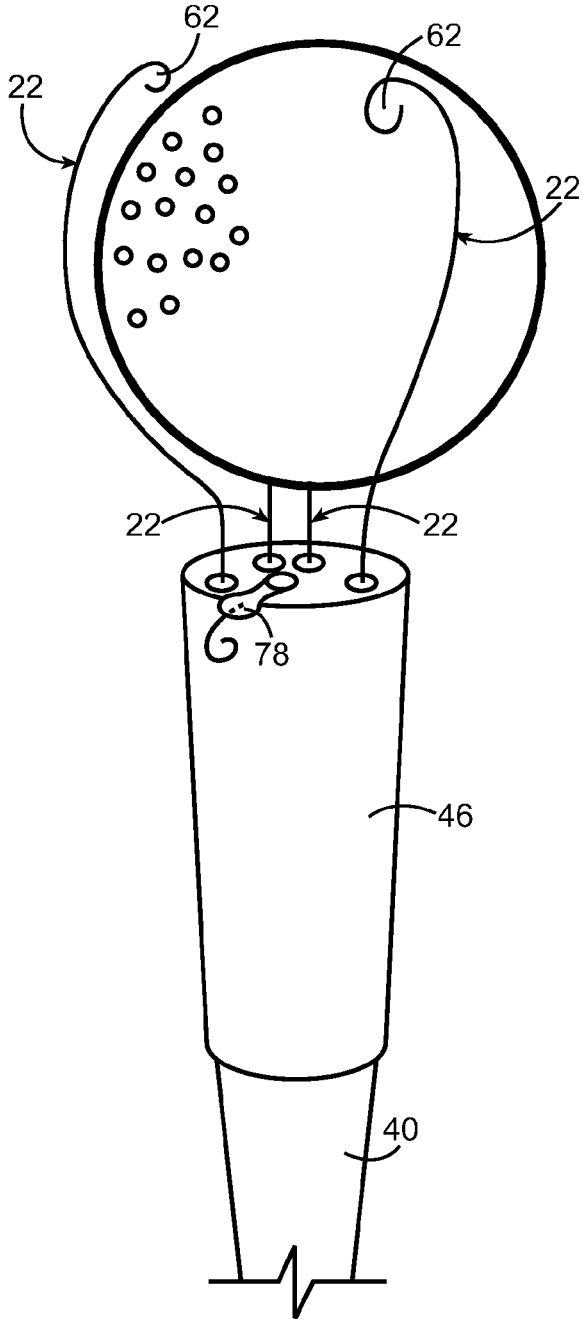
FIG. 5 is a side view of the retrieval system of FIG. 1 holding a golf ball.

The user then inverts system 20 and applies it to a golf ball. Loop 62 on each grappling wire 22 encounters the top of the golf ball, causing grappling wires 22 to bend outward around the top of the golf ball, and then back inwardly as further pressure is applied by the user, so that the golf ball is held securely within grappling wires 22, as shown in FIG. 5. The user can then invert the orientation of system 20 and remove the golf ball from grappling wires 22.

Figure 6:
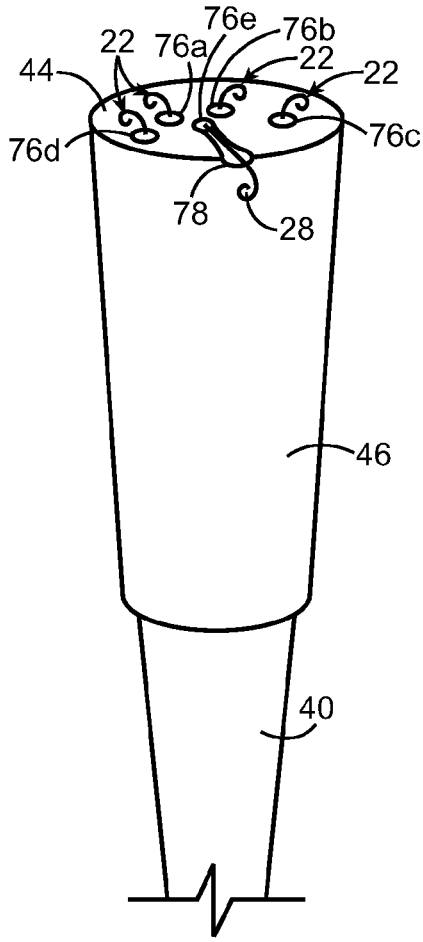
FIG. 6 is a side view of the retrieval system of FIG. 1 in the retracted position.

Once the golf ball is removed, the user applies pressure to grappling wires 22 to push them back into shaft 40. The user need only apply sufficient pressure to overcome the slight interference fit between sliding member 24 and bore 50, to force sliding member 24 to slide back into shaft 40, toward anchor member 26, until grappling wires 22 are completely within shaft 40. This retracted position is shown in FIG. 6. Because of the resilient material of grappling wires 22, curve sections 58, 60 straighten out within shaft 40. Preferably, hemispherical recesses 80 are formed around holes 76*a* through 76*e* in top 44 of grip 46, so that loops 62 of grappling wires 22 are recessed within top 44 and therefore do not protrude. Handle 28 protrudes slightly axially from the periphery of top 44 and there is no unaesthetic presentation or anything to interfere with operation.

Another embodiment of the present invention is retrieval system 120, shown in FIGS. 7*a* through 7*d*. System 120 has a plurality of grappling wires 122, a sliding member 124, an anchor member 126, a spring 128, a cap 130, and a locking assembly. Retrieval system 120 is preferably mounted in the top of a hollow shaft 140 of a golf club 142.

Grappling wires 122 are identical to wires 22 described above in connection with FIGS. 1 through 4. Grappling wires attach to sliding member 124 in the same manner as described above in connection with FIGS. 2 through 4.

Sliding member 124 is a cylindrical tube made of a solid material, such as wood, plastic, or metal. Sliding member 124 has an outer diameter forming a loose interference fit with the bore 150 of shaft 140, so that sliding member 124 will slide through bore 150 when force is applied to it, but will stay in position when force is released.

Anchor member 126 is a solid cylinder configured to be held in a single position within bore 150 of shaft 140. Anchor member 126 preferably forms a tight interference fit with bore 150, sufficient to hold anchor member 126 is a single position. In other embodiments, anchor member 126 is glued, soldered, welded, screwed, bolted, or attached by some other means. Anchor member 126 in other embodiments is a simple attachment of spring 134 to the wall of shaft 140, such as a bolt, solder, weld, a hook, or other means of attachment.

In a first embodiment, the locking assembly is plunger assembly 132, a flexible metal strip 190 attached to the distal end 154 of sliding member 124. At the proximal end 192 of strip 190 is a plunger 194. Plunger 194 is configured to fit loosely into aperture 196 in shaft 140.

Spring 128 is attached at a first end to anchor member 126. Spring 128 is attached at a second end to cap 130.

Figure 7A:
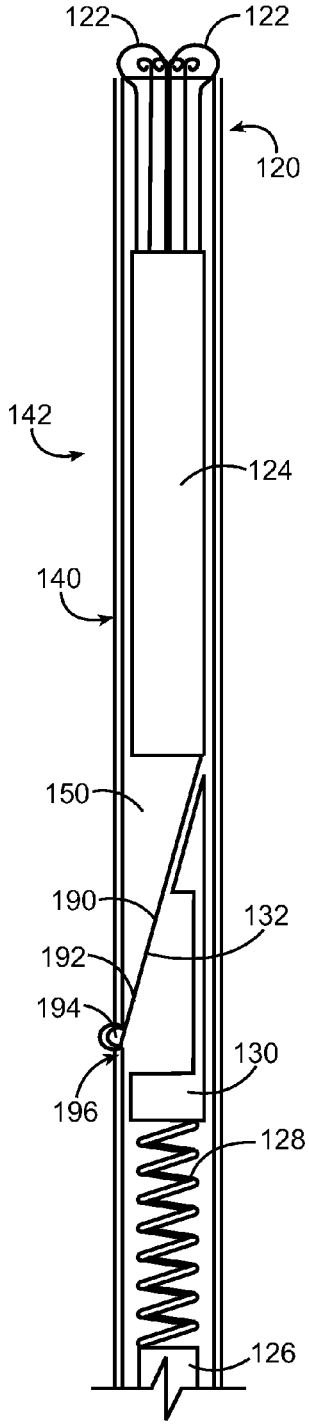
FIG. 7*a* is a partially cutaway view of another embodiment of the present invention, in the retracted position.

During use of club 42 before holing out, grappling wires 122 are in a retracted position as shown in FIG. 7*a*. In this position, sliding member 124 has been pushed down bore 150 of shaft 140, causing plunger assembly 132 to also move down shaft 140. When strip 194 reaches a position adjacent aperture 196, plunger 196 is forced radially outward, through aperture 196, due to the flexible condition of metal strip 190. The axial movement of plunger 196 thereby locks plunger assembly 132 in position relative to shaft 140, thereby preventing further movement of plunger assembly 132 or sliding member 124.

As plunger assembly 132 moved down bore 150, cap 130 was also moved down bore 150, compressing spring 128. When plunger assembly 132 is locked in position as described above, cap 130 cannot move up bore 150 and spring 128 remains compressed.

Figure 7B:
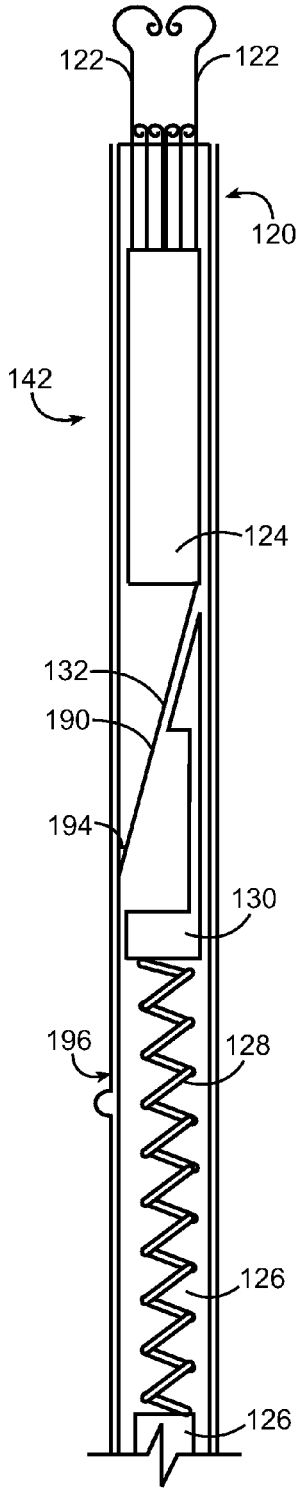
FIG. 7*b* is a partially cutaway view of the system of FIG. 7*a*.

When a user pushes on plunger 196, the compression of spring 128 pushes cap 130 upwards against plunger assembly 132, which then pushes sliding member 124 upwards, causing grappling wires 122 to extend from the retracted position, shown in FIG. 7*a*, to the extended position shown in FIG. 7*b*. System 120 can then be used to retrieve a golf ball, as described above in connection with FIG. 5, and can be retracted back to the retracted position by pushing on grappling wires 122, as described above.

Figure 7C:
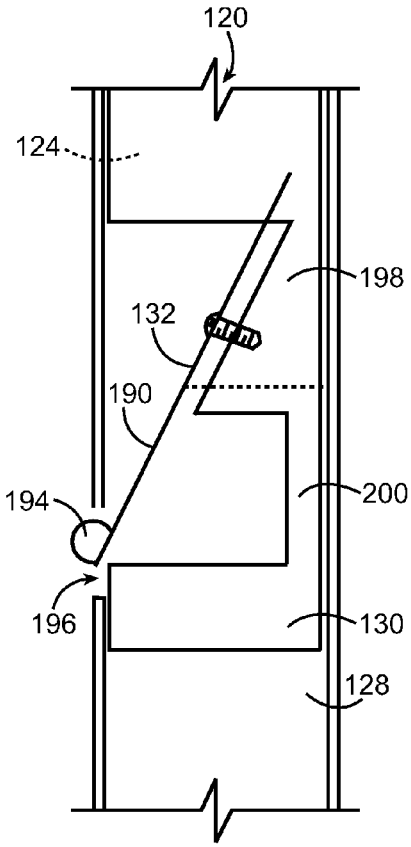
FIG. 7*c* is a partially cutaway detail view of another embodiment of the present system.

In yet another embodiment, sliding member 128 and cap 130 are an integral piece, connected by slanted section 198 and connection section 200, as shown in more detail in FIG. 7*c*.

Figure 7D:
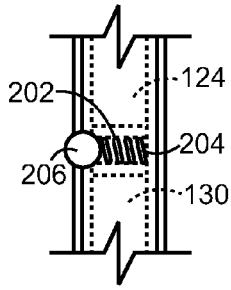
FIG. 7*d* is a partially cutaway view of yet another embodiment of the present invention.

In yet another embodiment, a bullet catch assembly 202 is used in place of plunger assembly 132 as a locking assembly. In this embodiment, as shown in FIG. 7*d*, bullet catch assembly 202 is placed between sliding member 128 and cap 130. Axial spring 204 pushes oil ball 206 within assembly 202. When assembly 202 is adjacent aperture 196, axial spring 204 pushes ball 206 radially outward, locking assembly 202 in place relative to shaft 140, and thereby preventing movement of axial spring 128. When a user pushes on ball 202, assembly 202 is unlocked and axial spring 128 pushes assembly 202 upwards, causing sliding member 128 to move upwards and causing grappling wires 122 to move from the retracted position of FIG. 7*a* to the extended position of FIG. 7*b*. Pushing on grappling wires 122 then causes sliding member 128 to move downward, pushing bullet catch assembly 202 back toward aperture 196, where ball 206 is pushed outward by axial spring 204 to engage aperture 196 and lock everything in place.

Retrieval systems 20 and 120 in first embodiments are manufactured and installed during manufacture of club 42 or club 142. Preferably, club 42 or club 142 is a putter, although retrieval systems 20 and 120 can be installed in any hollow-shaft club.

In other embodiments, an existing golf club is retrofitted to have retrieval systems 20 or 120.

In another embodiment, retrieval system 20 or system 120 is a dedicated golf ball retrieval device. In this embodiment, the elements are installed in a hollow shaft 40 or hollow shaft 140 that is not part of a golf club. A user can keep this dedicated device in the golf bag without running afoul of the rule limiting the number of clubs a golfer can carry.

While preferred embodiments of the present invention are shown and described, it is envisioned that those skilled in the art may devise various modifications of the present invention without departing from the spirit and scope of the appended claims.

I claim:

1. A golf ball retrieval system comprising:

a hollow shaft having an anchor member mounted within said shaft;

a sliding member movable axially within said shaft, said sliding member having a bore axially therethrough;

a plurality of grappling wires connected to a proximal end of said sliding member;

a wire passing through said bore, said wire having a first end and a second end, said wire further comprising a handle at said first end, said handle protruding from said shaft, said second end of said wire being attached to a first end of a spring, a second end of said spring being attached to said anchor member; and a shoulder attached to said wire between said spring and said sliding member.

2. The system of claim 1, wherein each said grappling wire comprises an attachment section, an outward curving section attached to said attachment section, an inward curving section attached to said outward curving section, and a loop at an end of said inward curving section.

3. The system of claim 1, wherein each said grappling wire is mounted within a hole in said sliding member.

4. The system of claim 1, wherein each said grappling wire is held between a head on said sliding member and a sleeve over said head.

5. The system of claim 1, wherein said plurality of grappling wires are formed of spring steel.

6. A golf club, comprising the system of claim 1.

* * * * *